US005806717A

United States Patent [19]

De Rosenzeig-Page et al.

[11] Patent Number: 5,806,717

[45] Date of Patent: Sep. 15, 1998

[54] LOW COST DISPENSING BAGS FOR LIQUID SOAP WITH A MEASURING CHAMBER AND SEALED EXIT SPOUT FOR DISPENSING IN A SIMPLIFIED DISPENSING MECHANISM

[75] Inventors: Carlos Augusto De Rosenzeig-Page, San Pedro Garza Garcia, Mexico; Jesus Hernan Herrera-Gutierrez, Antiguo Camino A San Agustin #999, Residencial San Agustin, C.P. 66270, San Pedro Garza Garcia, Nuevo Leon, Mexico

[73] Assignee: Jesus Hernan Herrera-Gutierrez, Nuevo Leon, Mexico

[21] Appl. No.: 644,280

[22] Filed: May 10, 1996

[51] Int. Cl.[6] ..... A47K 5/12; B65D 35/28

[52] U.S. Cl. ..... 222/105; 222/214

[58] Field of Search ..... 222/105, 107, 222/207, 214, 183, 181.2, 181.3

[56] References Cited

U.S. PATENT DOCUMENTS

| | | | |
|---|---|---|---|
| 3,768,704 | 10/1973 | Beguin | 222/207 |
| 4,463,876 | 8/1984 | Swallert | 222/214 X |
| 4,932,562 | 6/1990 | Christine | 222/214 X |
| 5,067,635 | 11/1991 | Thomsen | 222/105 X |
| 5,242,083 | 9/1993 | Christine et al. | 222/105 X |
| 5,377,871 | 1/1995 | Banks et al. | 222/105 X |

FOREIGN PATENT DOCUMENTS

| | | | |
|---|---|---|---|
| 329532 | 8/1989 | European Pat. Off. | 222/105 |
| 433905 | 6/1991 | European Pat. Off. | 222/214 |
| 93005693 | 4/1993 | WIPO | 222/214 |

*Primary Examiner*—Kevin P. Shaver
*Attorney, Agent, or Firm*—Laurence R. Brown

[57] ABSTRACT

This invention provides a flexible bag for soft soap having a measuring valve formed by an injector body and a liquid dispenser. The injector chamber is formed by a tubular element, preferably a plastic pipe, sealed in the lower part of the bag. When this injector is pressed, it sends the soap contained in the injector chamber towards the exit, which opens letting the soap out, after which it closes automatically once the pressure is removed. A compressor in the dispenser's cover, when pressed, squeezes the tubular device, which forms an injector chamber, against the back, forcing the soap contained in the injector chamber to exit. When the compressor is released, the injector chamber sucks in, closing the exit seal and refilling soap from the bag.

3 Claims, 9 Drawing Sheets

LOW COST DISPENSING BAGS FOR LIQUID SOAP WITH A MEASURING CHAMBER AND SEALED EXIT SPOUT FOR DISPENSING IN A SIMPLIFIED DISPENSING MECHANISM

BACKGROUND OF THE INVENTION

A considerable plurality of bag type liquid dispensers exists so far in the field of the corresponding industry.

All of them go from sophisticated electronic devices, soap systems using flexible bags that cannot be refilled with the principal advantage of maintaining the product hermetically sealed the preventing its contamination, to simple dispensers with valves that provide soap to the user through pressure, but no doubt all of them have the great inconvenience of operating with relatively complicated components, in order to provide the right measure and to make sure that the exit stays permanently closed as long as the device is not used. This causes the problem that with the failure of components the natural operation of such devices is obstructed.

With the use of this invention the operation is simplified in such a way that all inconveniences previously mentioned are solved. Furthermore, the invention provides very inexpensive manufacturing of a bag for liquid soap including a measuring device as the principal element and a dispenser as well, is practical to install, inexpensive and accurate in operation, as consequence of an uniform measure. An automatic effective seal is provided as soon as the pressure over the injector chamber is released, without the need of other accessories.

Characteristic details of this invention are clearly shown in the following description and in the drawings accompanying it as an illustration. The same reference signs indicate the same parts throughout the shown figures.

DESCRIPTION OF THE INVENTION

Figure 10:
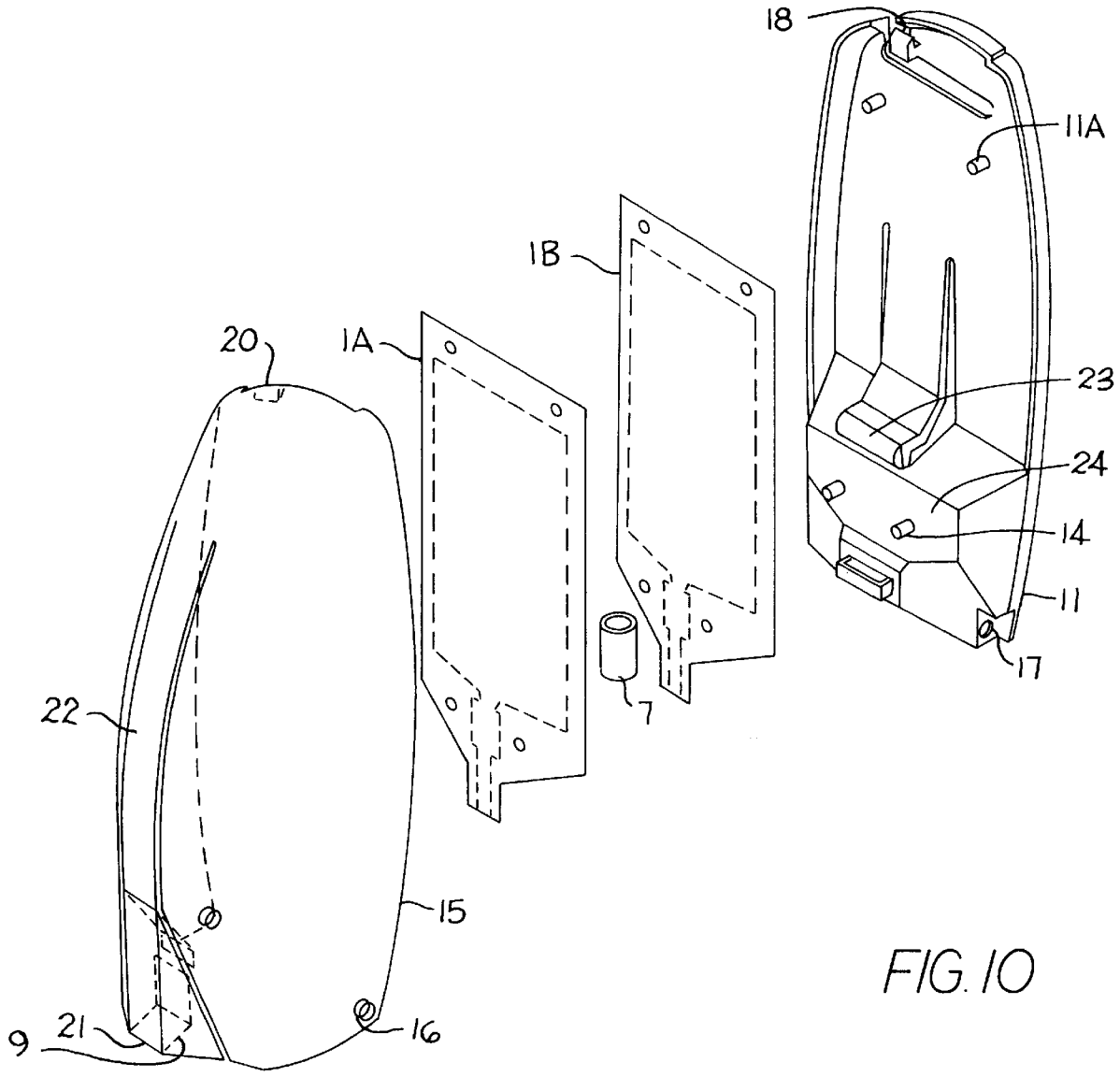
FIG. 10 shows an exploded view of the bag, the cover and the base.

In reference to said figures, this invention comprises in combination, a body (1), generally made of flexible material resulting of sealing two flat elements (1A and 1B, FIG. 10) joined by means of two lower partial seals (2A and 2B), and lateral seals (3). The entrance (4) by which the bag (1) is filled is thereafter closed by means of an upper seal (1C). At its lower end the bag holds between its flat elements (1A and

Figure 1:
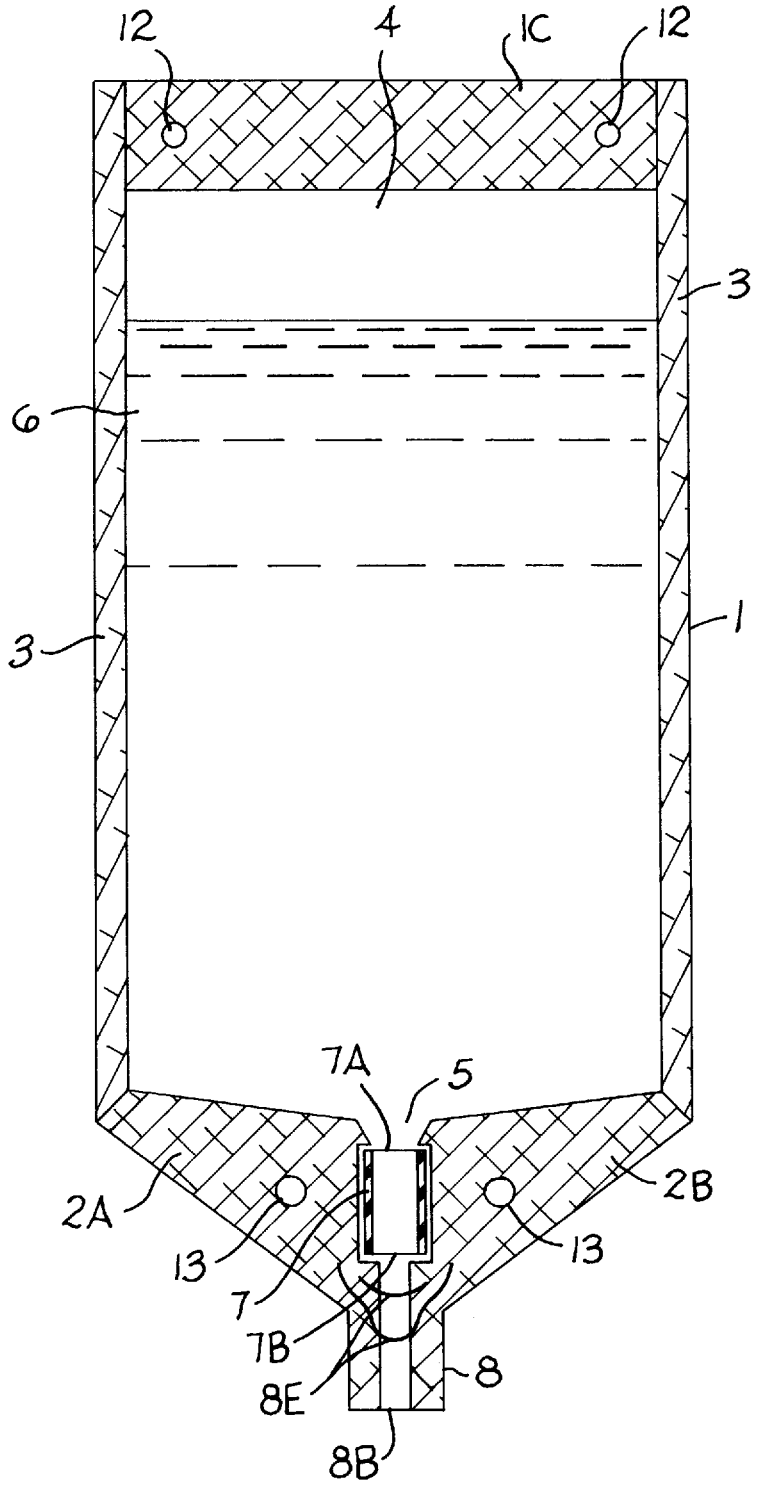
FIG. 1 shows a section view in elevation of the bag showing contents, seals, injector and parts.
Figure 2:
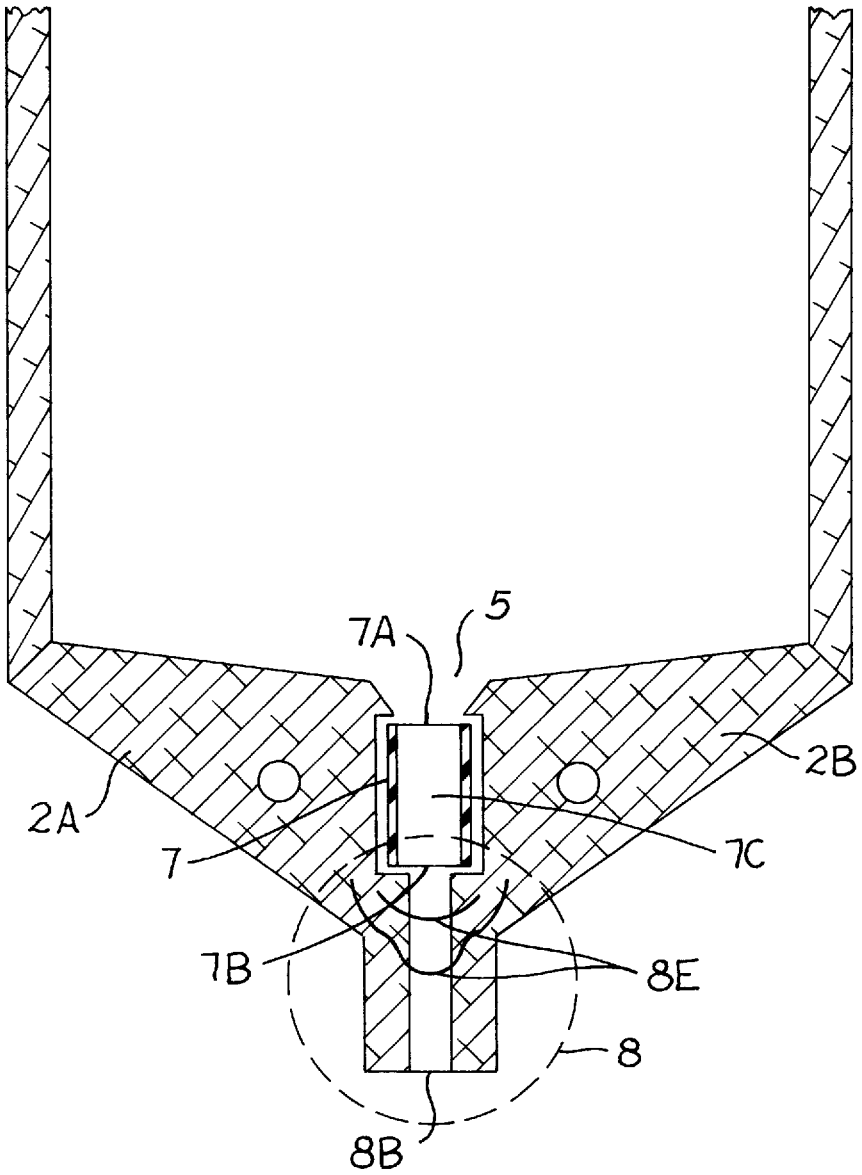
FIG. 2 shows a section detailed view in elevation of the bag, part of the injector chamber, seals and fold.
Figure 3:
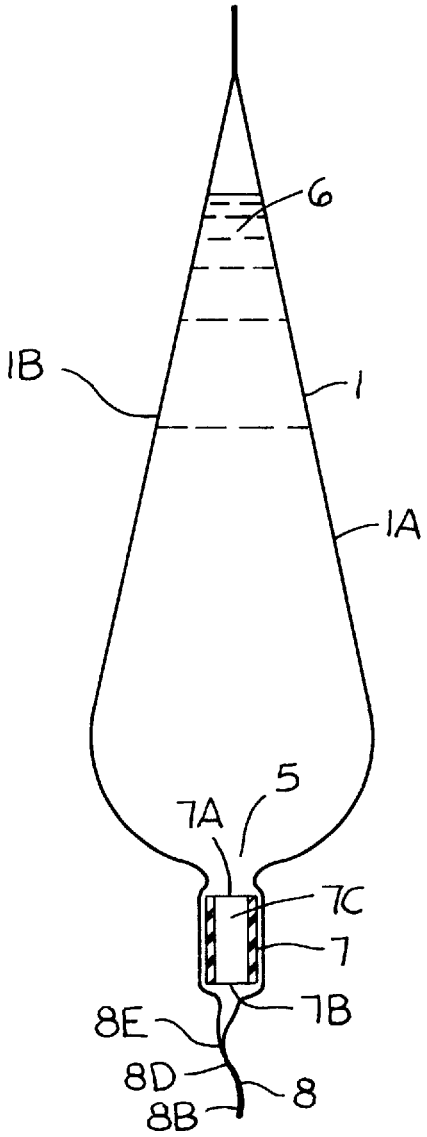
FIG. 3 shows a side sectional view of the bag, partly in section.
Figure 4:
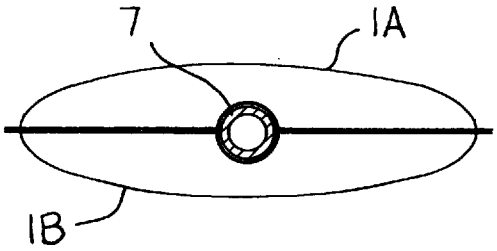
FIG. 4 shows an end view of the injector, partly in section.
Figure 5:
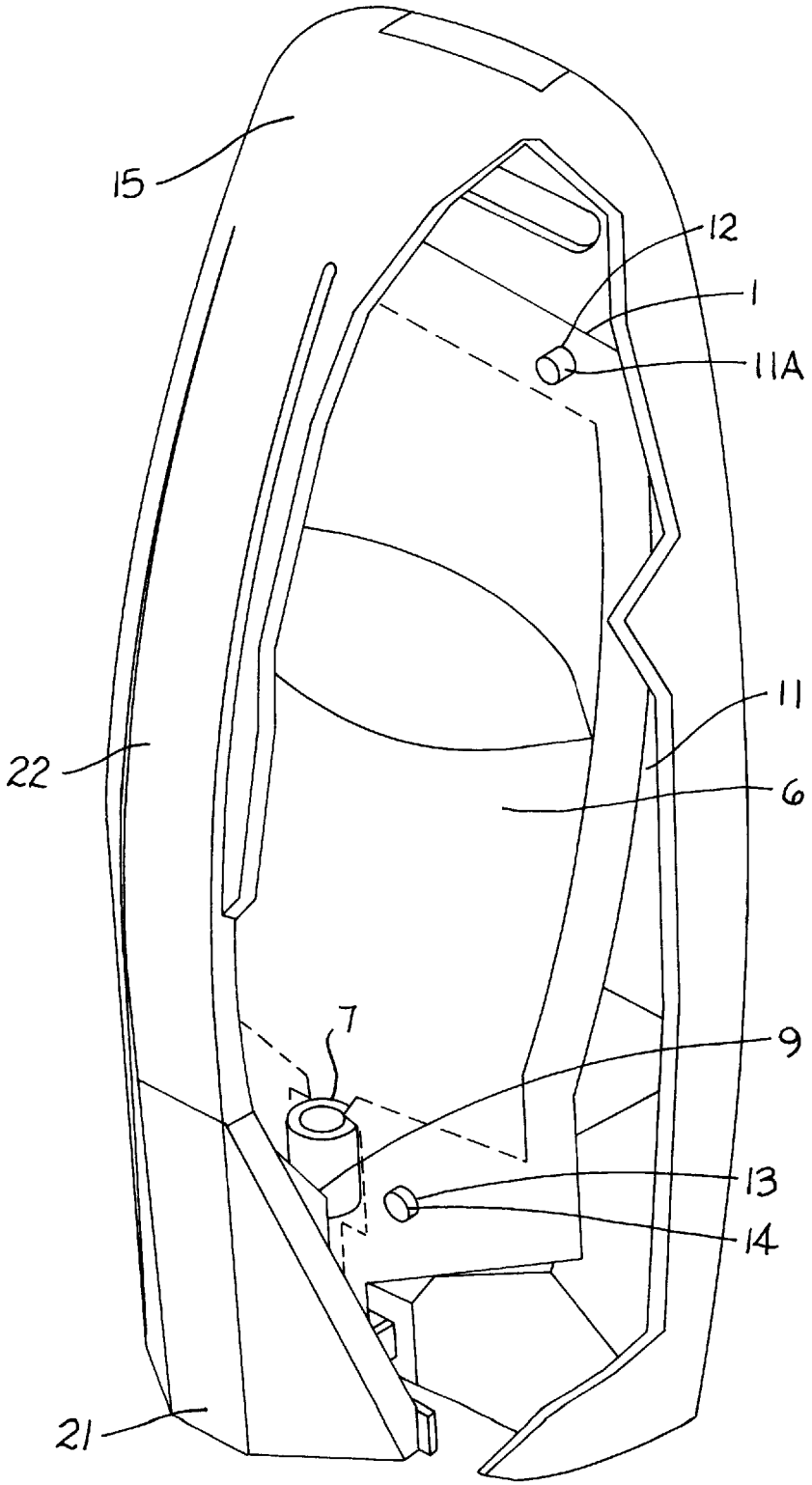
FIG. 5 shows an isometric view of the bag type liquid dispenser partially in section view to show the bag.
Figure 6:
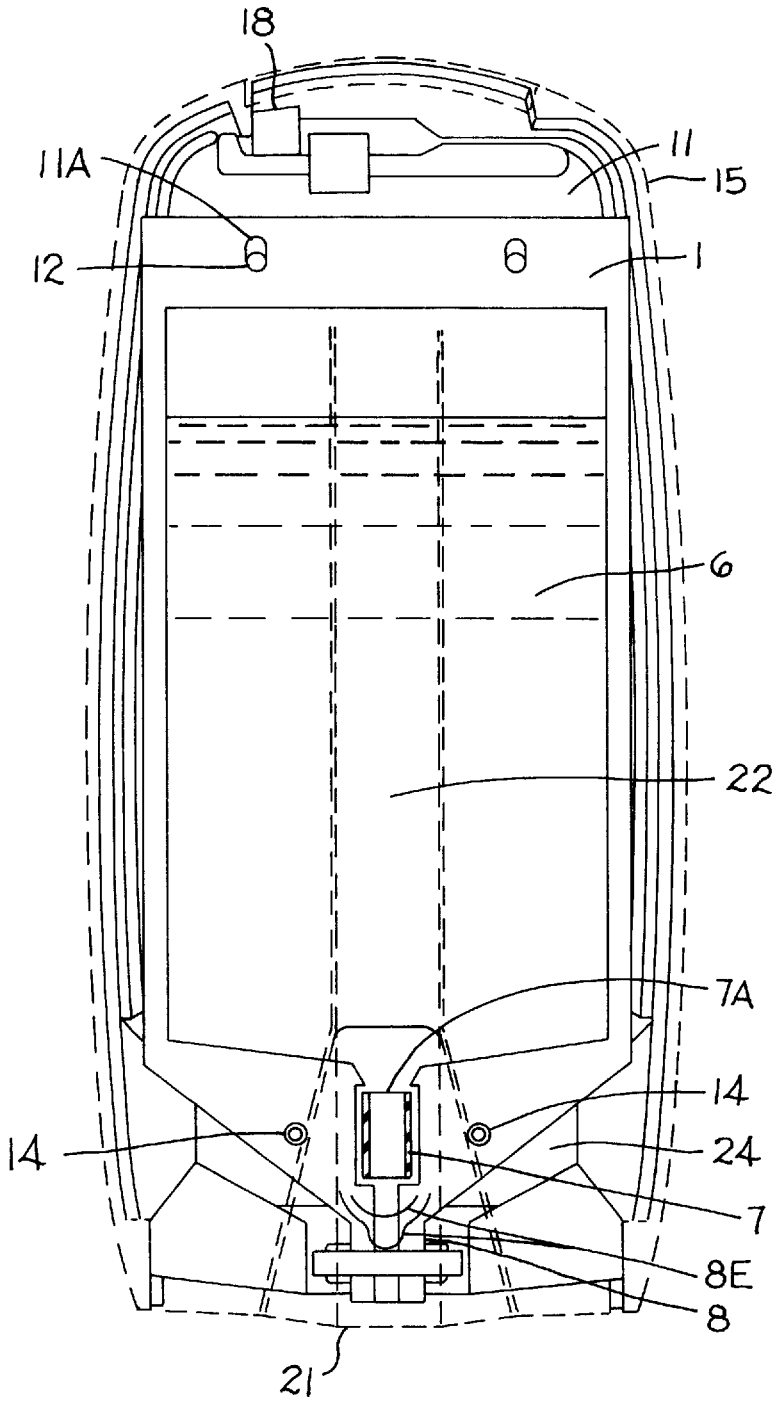
FIG. 6 shows an elevated phantom view with the dispenser's cover in dotted lines and with the bag mounted in the dispenser, as shown in section view.
Figure 7:
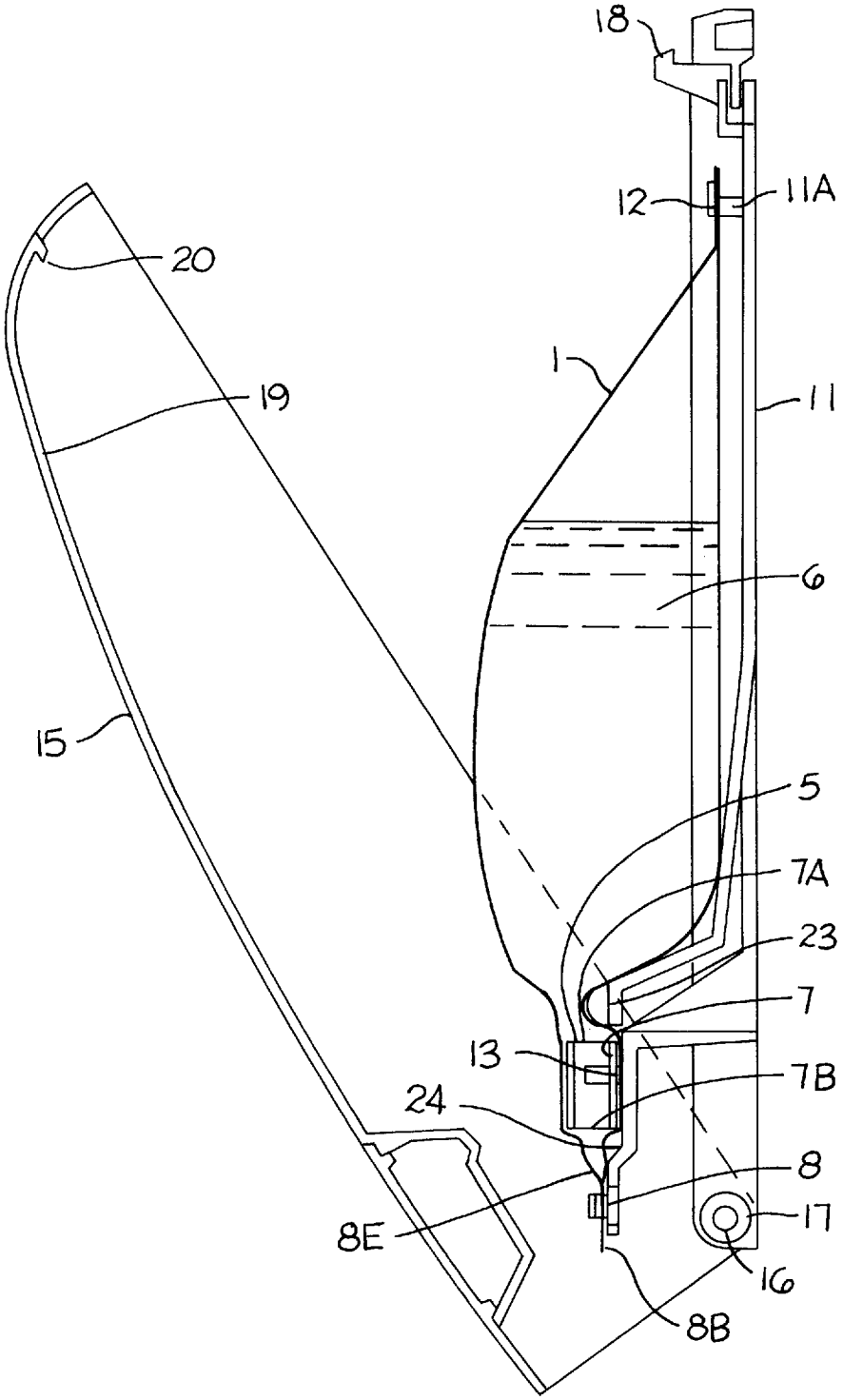
FIG. 7 shows a side section view of the bag as mounted in the dispenser with half-opened cover.
Figure 8:
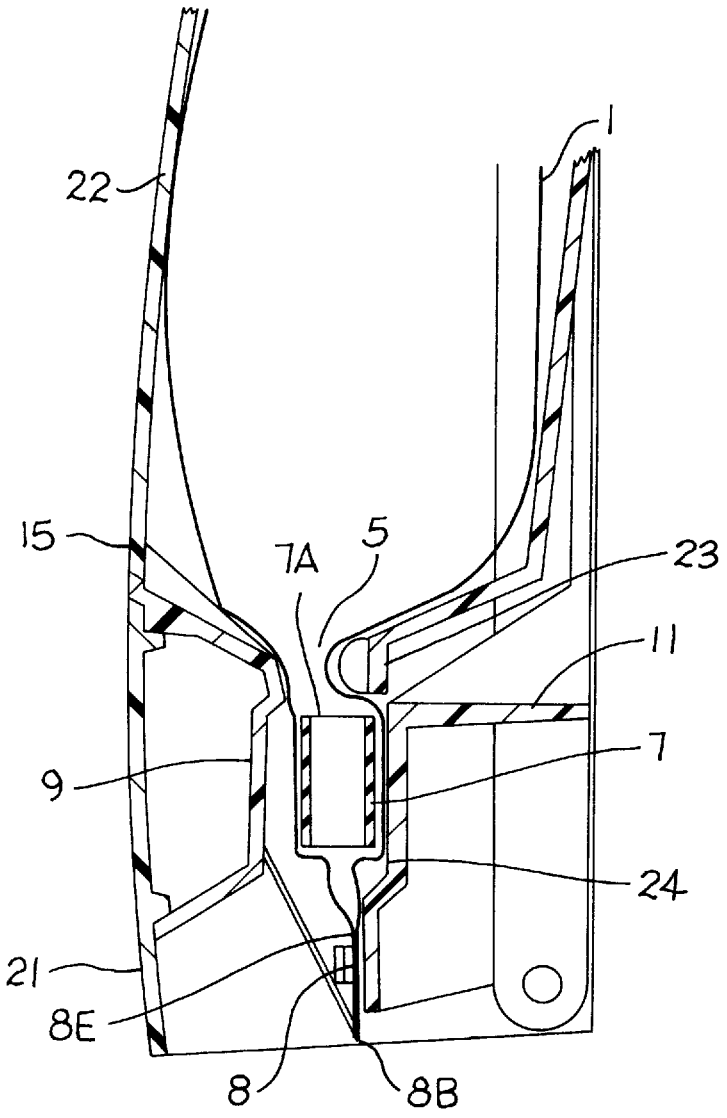
FIG. 8 shows a detailed fragmented view in section of the bag mounted in the dispenser with the cover in closed position.
Figure 9:
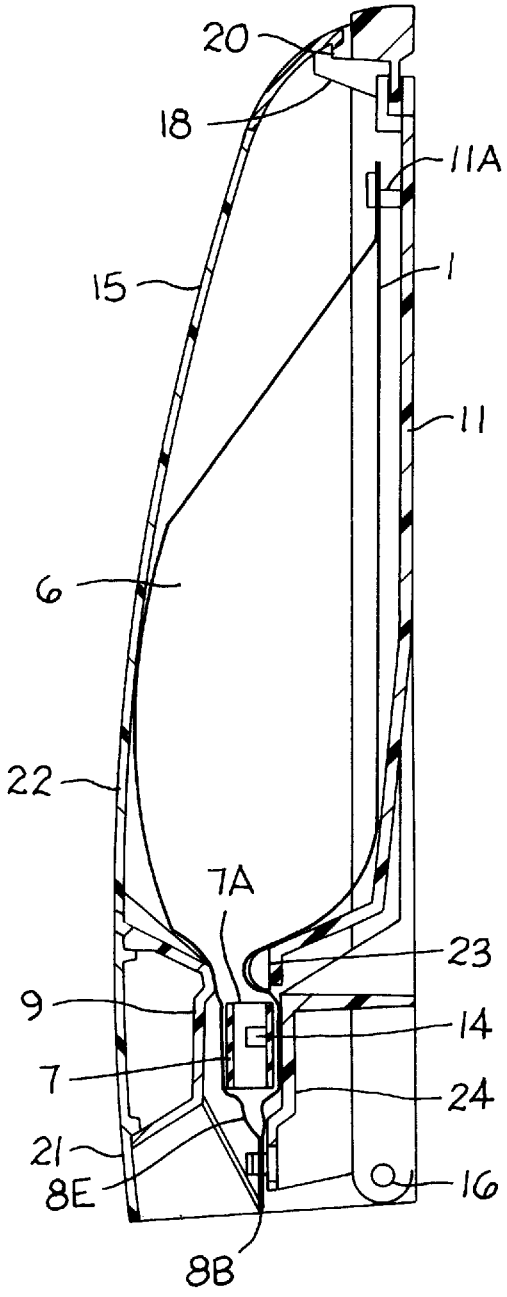
FIG. 9 shows a full sectional view of the bag mounted in the dispenser with the cover closed.

1B) an injector chamber (7, 7A, 7B, 7C) with a principal element formed by a tubular device, preferably a plastic pipe, made of an elastic material which may be rubber or plastic, with enough memory to maintain its form even if it is periodically pressed. The injector chamber (7) is positioned in such a way that its entrance (7A) communicates with the exit (5) of the bag (1) and consequently with the interior of the bag where the liquid soap (6) is stored. The lower end (7C) of the injector chamber (7) ends at an exit (7B) which runs into the supplying seal (8). When the injector chamber (7) is pressed by means of the compressor (9 FIG. 5), which because of its shape presses first the exit (5) of the bag (1) against the butt (23) and thereafter the entrance (7A) and the injector chamber's body (7) against the back (24, FIG. 5), the soap (6) contained in the interior of the injector chamber (7) is forced towards the supplying seal (8) which will open and permit the soap (6) to flow through its exit (8B). When the compressor (9) is released, the tubular device of the injector chamber (7) returns to its original form (as a result of its memory), closing the supplying seal (8) by suction and at the same time refilling the injector chamber (7) with the soap (6) contained in the bag (1). This soap will remain in the interior (7C) of the injector chamber (7) until pressure is produced again by means of the compressor (9) in order to repeat the exit function previously described.

The supplying seal (8) is simply formed by the union of the flat elements (1A and 1B), and by means of the partial seals (2A and 2B), which allow the supplying seal (8) to open when the soap (6) flows out because of pressure, and to close because of a fold(8E) resulting between elements (1A and 1B) as a consequence of the design produced by the partial seals (2A and 2B) when forming the cavity made by the injector chamber (7). This improvement prevents free flow or dripping that could result from the storage of the soap (6) in the interior (7C) of the injector chamber (7).

With the purpose of holding the bag (1) in the base (11) of the dispenser (10), said bag (1) has upper holes (12) specifically placed in the upper part of it, which are hooked to the upper pegs (11A).

As a result of the combined operation of the injector chamber (7) and the supplying seal (8), a valve is provided to open when the injector chamber (7) is pressed by the compressor (9), providing the determined measure of soap required by the user, for example to wash his hands, and to close automatically joining its walls (8D) when the injector chamber (7) is released from pressure.

On each side of the injector chamber (7) the bag (1) has lower holes (13) by means of which the lower area of the bag remains held to the lower pegs (14), which are located in the lower part of the base (11).

The dispenser (10) is formed by two main bodies, the base (11) and the cover (15), joined by an axis (16) which is an integral part of the cover (15) which is inserted in the holes of the base (11), allowing an axial rotation to open and close the cover (15) over the base (11).

With the purpose that the cover (15) remains firmly held to the base (11) when it is closed, the base (11) has a latch (18) in its upper end, while the cover (15) is provided with a mating hook (20) in its internal face (19), so when forced against the latch (18), the cover (15) remains held by it until it is opened again.

The compressor (9) is mounted to the middle lower part (21) of the cover (15), and is held to the cover (15) by means of an elastic element (22) which permits its working when it is pressed, after which it returns to its original position when the pressure is released. When the injector chamber (7) is pressed by the compressor (9), because of its shape, first the exit (5) of the bag (1) is pressed against the butt (23) and then the injector chamber (7) against the back (24), forcing the soap (6) contained in the interior towards the supplying seal (8) which will be opened, allowing the soap (6) to flow out through its exit (8B). When the compressor (9) is released, the injector chamber (7), as a result of its memory, returns to its original form, closing the supplying seal (8) by suction, and refilling with the soap (6) contained in the bag (1).

What is claimed is:

1. A flexible liquid soap dispensing bag consisting in combination: two flat flexible sheets being shaped to provide an exit passageway for dispensing fluids at one end thereof opposite a reservoir end for retaining said liquid soap, an internally contained length of cylindrical flexible pipe of constant diameter disposed between the two sheets adjacent the exit passageway, and said sheets being sealed together in a sealing pattern about the periphery except for the exit passageway, said flexible sheets being flat contiguous sheets at the exit passageway with the sheets sealed together on opposite sides of the exit passageway to define a flat narrow normally closed exit aperture spout.

2. The combination of the dispensing bag of claim 1 with a dispenser having a dispensing mechanism comprising in combination, a closed compartment for encompassing said dispensing bag with the flexible pipe and exit passageway in a lowermost dispensing chamber, and a valve comprising a movable elastic element carrying an oppressor configuration for clamping the two bag sheets together in sequence first above the flexible pipe and thereafter for collapsing the flexible pipe to force liquid contained by the flexible pipe out of the exit passageway.

3. The combination of a liquid soap reservoir bag and a dispensing container therefor, comprising in combination:

said liquid soap reservoir bag with flexible sidewalls defining a soap containing reservoir compartment and a dispensing compartment, said dispensing compartment consisting of a length of constant diameter cylindrical flexible pipe confined inside the bag by said flexible sidewalls adjacent to a flat narrow exit passageway defining an exit spout formed by a seal comprising two contiguous flat flexible sidewalls closing the exit spout with a characteristic that the liquid soap is dispensed therethrough when external pressure is applied to liquid soap within the reservoir compartment sufficient to overcome said seal closing the exit passageway, and said dispensing container having an internal compartment for holding the soap reservoir bag with the flexible pipe and exit passageway disposed in a lowermost chamber and a dispensing mechanism adjacent the lowermost chamber comprising a movable oppressor member configuration movable into said sidewall for sealing the two sidewalls of the soap reservoir bag between the storage reservoir and the soap containing reservoir compartment, thereby dispensing soap from said dispensing compartment by squeezing the flexible pipe with said oppressor member to exert external pressure of a magnitude forcing the liquid soap out of the exit spout.

* * * * *